US006996941B1

(12) United States Patent
Maschoff

(10) Patent No.: US 6,996,941 B1
(45) Date of Patent: Feb. 14, 2006

(54) PORTABLE FOLDABLE TENT AND METHOD FOR ERECTING SAME

(76) Inventor: Eldean P. Maschoff, 219 W. Seneca, Bancroft, IA (US) 50517

( * ) Notice: Subject to any disclaimer, the term of this patent is extended or adjusted under 35 U.S.C. 154(b) by 372 days.

(21) Appl. No.: 10/420,241

(22) Filed: Apr. 22, 2003

(51) Int. Cl.
*E04H 1/12* (2006.01)
*E04B 1/343* (2006.01)

(52) U.S. Cl. ..... 52/79.5; 52/82; 52/143; 52/745.19; 135/122; 135/905; 135/912

(58) Field of Classification Search ..... 52/63, 52/68–69, 79.5, 82, 745.19, 143; 135/143–145, 135/121–122, 905, 912
See application file for complete search history.

(56) References Cited

U.S. PATENT DOCUMENTS

| | | | | |
|---|---|---|---|---|
| 3,343,321 | A | 9/1967 | Axelsson | |
| 3,811,235 | A * | 5/1974 | Powell | 52/69 |
| 3,841,603 | A | 10/1974 | Lund et al. | |
| 4,026,076 | A * | 5/1977 | Analetto | 52/6 |
| 4,170,852 | A * | 10/1979 | Danis, Jr. | 52/71 |
| 4,558,713 | A | 12/1985 | Hagler et al. | |
| 4,630,627 | A | 12/1986 | Windows et al. | |
| 4,831,807 | A | 5/1989 | Bolt | |
| 5,152,109 | A * | 10/1992 | Boers | 52/143 |
| 5,461,832 | A * | 10/1995 | Smith | 52/69 |
| 6,318,043 | B1 | 11/2001 | Johnson | |
| 6,434,895 | B1 * | 8/2002 | Hosterman et al. | 52/143 |
| 6,742,309 | B1 * | 6/2004 | Stewart et al. | 52/79.5 |
| 6,763,633 | B1 * | 7/2004 | Cote | 52/71 |
| 6,874,520 | B1 * | 4/2005 | Carter | 135/145 |

FOREIGN PATENT DOCUMENTS

| | | | |
|---|---|---|---|
| JP | 360018485 A | | 1/1985 |
| JP | 8-105243 | * | 4/1996 |
| JP | 11-62323 | * | 3/1999 |

* cited by examiner

*Primary Examiner*—Winnie Yip
(74) *Attorney, Agent, or Firm*—McKee, Voorhees & Sease, P.L.C.

(57) ABSTRACT

The present invention includes a folding tent that can be moved to a folded position and mounted on a trailer for transporting. The tent can then be fanned out to an unfolded configuration and the trailer can be used to lift the tent upwardly. The legs are then folded downwardly into support relationship for the roof and the trailer can be moved.

10 Claims, 6 Drawing Sheets

PORTABLE FOLDABLE TENT AND METHOD FOR ERECTING SAME

BACKGROUND OF THE INVENTION

The present invention relates to a portable foldable tent and method for erecting same.

There are many forms of tents or canopies which are portable and which can be erected at the desired site. Often these folding tents are rented to various groups for outdoor parties.

The current tents fall into three different categories. The traditional category includes poles in the center and poles at the eve that are held in place with ropes and stakes. This type of traditional tent is difficult to put up, and is unstable if a leg is removed or ropes are removed. It is labor intensive and it takes at least two people or more to erect such a tent.

Another form of tent is a frame tent. This usually consists of an aluminum frame work that supports a canopy or cover. It may also be constructed of light weight steel, wood or even fiberglass. This type of tent does not have a center pole arrangement. The rafters are of a truss type and are supported by poles at the outside edge or eve of the tent. This type of tent requires extra labor and crude portable lifting devices to erect. It is labor intensive and time consuming to assemble and takes two or more people to erect.

A third type of tent is a tension tent. This type of tent utilizes center poles and may use outer poles at the eve. It differs from the foregoing two types of tents in that it uses the tarp for stability instead of a rope as in the traditional tent. It is labor intensive to erect and is time consuming. It requires two or more people to erect it.

In view of the foregoing a primary object of the present invention is the provision of an improved portable foldable tent and method for erecting same.

A further object of the present invention is the provision of a tent that is designed to be transported on a trailer or truck bed.

A further object of the present invention is the provision of a tent that is designed to be easily erected by one person in normal weather conditions.

A further object of the present invention is the provision of a tent that can be erected in less than one-half hour.

A further object of the present invention is the provision of a tent that is designed so all parts are self-contained or attached to the frame work.

A further object of the present invention is the provision of a tent that is designed so that a tarpaulin or cover is attached to the frame work.

A further object of the present invention is the provision of a tent that can be erected by mechanical means, namely a winch or a cable or a hydraulic actuator or a hydraulic cylinder.

A further object of the present invention is the provision of a tent that is designed to be free standing in normal weather conditions.

A further object of the present invention is the provision of a foldable tent which has varying sizes ranging from 16 foot squares to 24×40 foot rectangular shape.

A further object of the present invention is the provision of a tent which can be formed in a square, a rectangle, or an octagon or other irregular shapes without detracting from the invention.

A further object of the present invention is the provision of a folded tent that is designed to fit in a normal size garage for storage.

A further object of the present invention is the provision of a folded tent that is covered so that it can be towed at highway speed.

A further object of the present invention is the provision of a portable, foldable tent and method for erecting same that are efficient in operation, durable in use, and economical to manufacture.

BRIEF SUMMARY OF THE INVENTION

A portable folding tent includes a trailer having wheels for engaging a support surface. A lift mechanism is mounted on the trailer and comprises a lift head. The lift mechanism is movable from a lowered position wherein the lift head is adjacent the trailer to an elevated position wherein the lift head is above the trailer. An extensible power member having a first end connected to the trailer and a second end connected to the lift mechanism is capable of raising and lowering the lift mechanism between the elevated and lowered positions respectively. A roof frame is comprised of a central frame and a plurality of roof support members, each having a first end connected to the central frame and a second end extending away from the central frame. A plurality of legs each has an upper leg end connected to one of the second ends of the roof support members and a lower end. A flexible sheet member is attached in covering relation over the roof support members. The lift head of the lift mechanism engages and supports the central frame of the roof frame whereby the lift mechanism will raise the central frame as the lift mechanism moves from its lowered position to its elevated position.

According to another feature of the invention, the portable tent comprises a roof frame formed of a central frame and a plurality of roof support members. Each of the roof support members has a first end connected to the central frame and a second end extending away from the central frame. A plurality of legs each have an upper leg end connected to one of the second ends of one of the roof support members and a lower leg end. The plurality of roof support members are pivotally mounted to the central frame for movement from a folded position to a fanned position wherein the plurality of roof support members are arranged in a circular array with the central frame at the center and with the roof support members extending in a radial direction away from the central frame. Each of the plurality of legs is pivotally connected to one of the second ends of one of the roof support members for folding movement from a folded position to an upstanding position wherein the lower leg end engages the supporting surface and the leg extends upwardly to the upper leg end connected to one of the second ends of one of the roof members. The plurality of roof support members and legs, when in their respectively folded positions, are more compact and occupy less space than when the roof support members are in their respective fanned positions and the legs are in their respective upstanding positions.

The method of the present invention involves transporting a tent frame in a folded state on a trailer to the site for erecting the tent. The roof support members are pivoted from a folded to a fanned position extending in an outward radial direction from the central frame. The central frame and the roof support members are then lifted from a lowered position adjacent the supporting surface to an elevated position spaced a predetermined distance above the supporting surface. The legs are then pivoted from a folded position to an upstanding position wherein the lower ends of the legs engage the supporting surface and the upper ends of the legs support the central frame and the roof support members in the elevated position.

DETAILED DESCRIPTION OF THE PREFERRED EMBODIMENT

Figure 1:
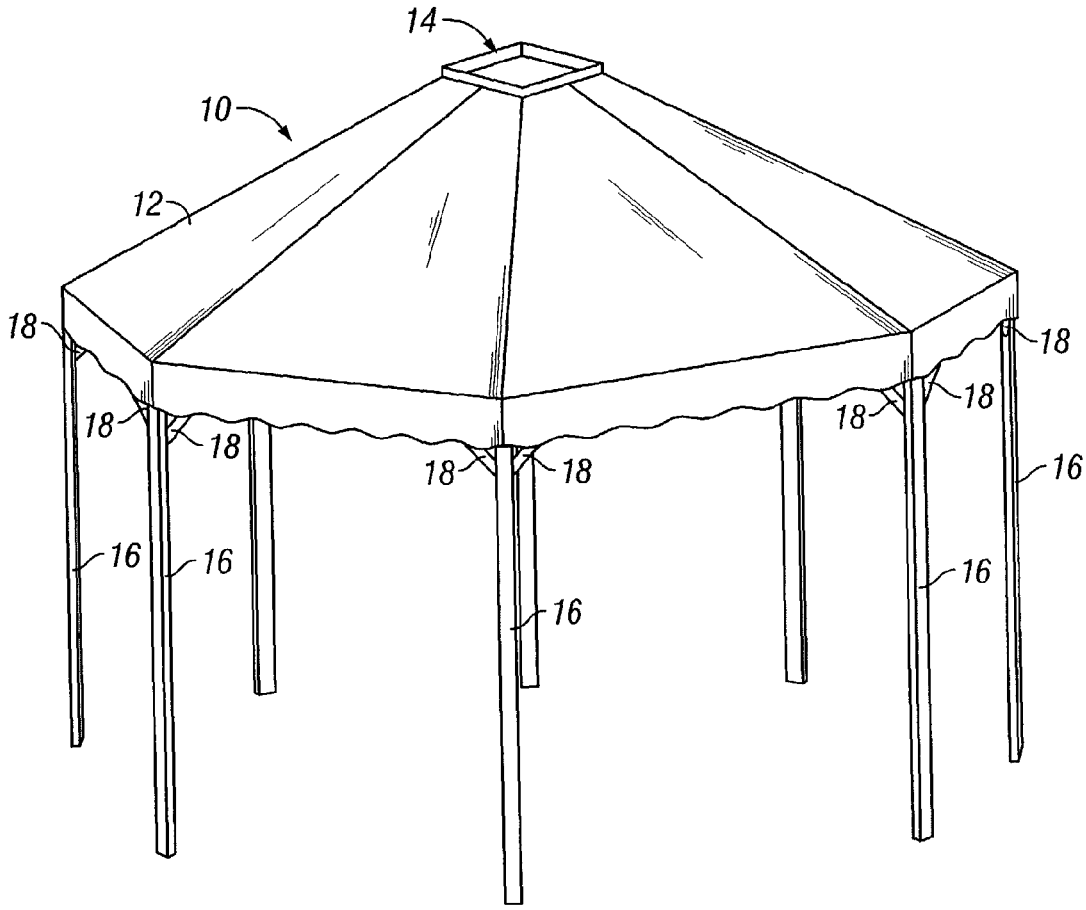
FIG. 1 is a perspective view of an erected tent made according to the present invention.

Referring to the drawings the numeral 10 generally designates the portable foldable tent of the present invention shown in its erected condition.

Tent 10 includes a canvas awning or tarpaulin 12 which forms a roof for the tent. A central crown 14 is provided at the center of the tarpaulin tent and can be provided with an opening for permitting air to escape as heat accumulates under the tarpaulin. A plurality of legs 16 are spaced around the outer perimeter of the tarpaulin 12 and include a plurality of struts 18 for supporting them in a vertical position.

Figure 2:
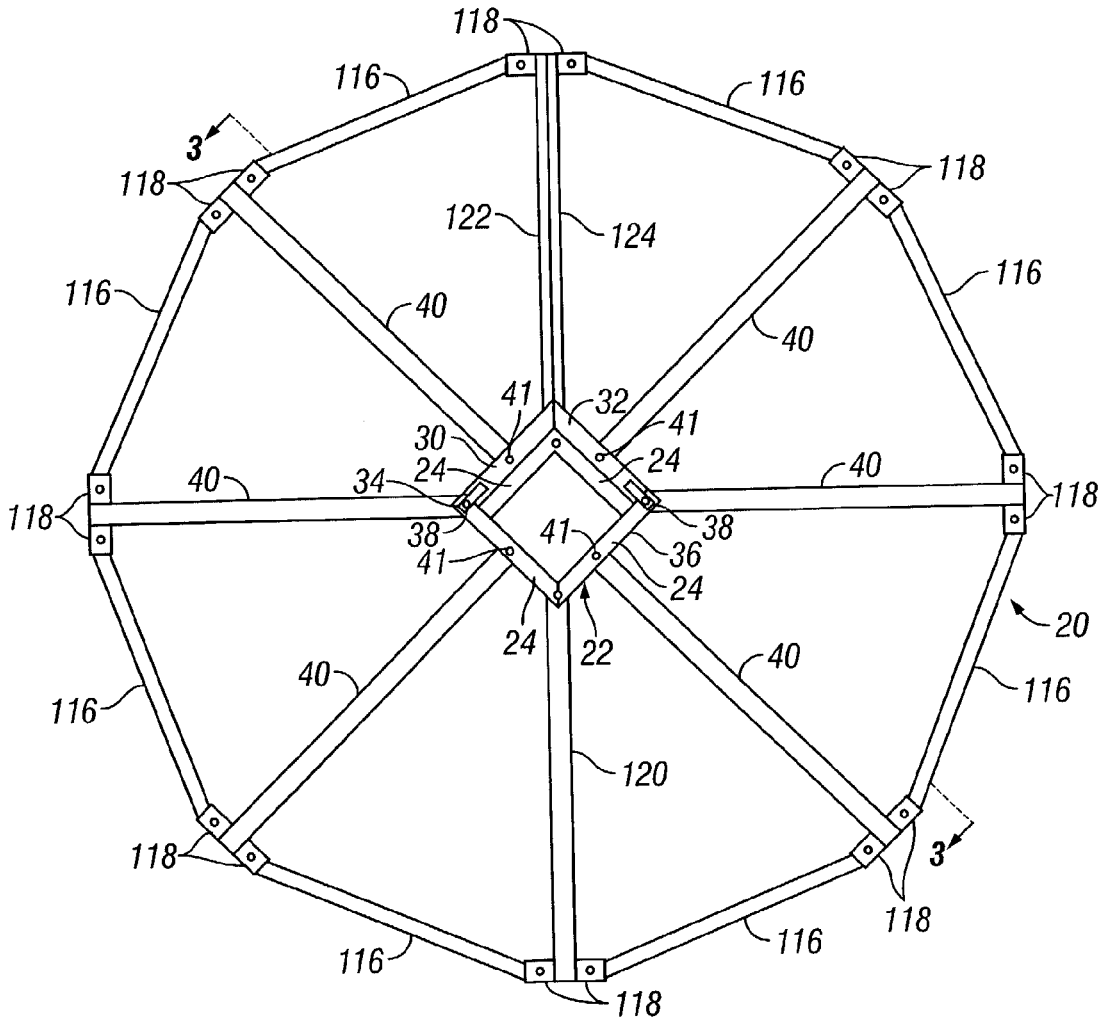
FIG. 2 is a top plan view of the frame structure beneath the tarpaulin of the tent shown in FIG. 1.
Figure 3:
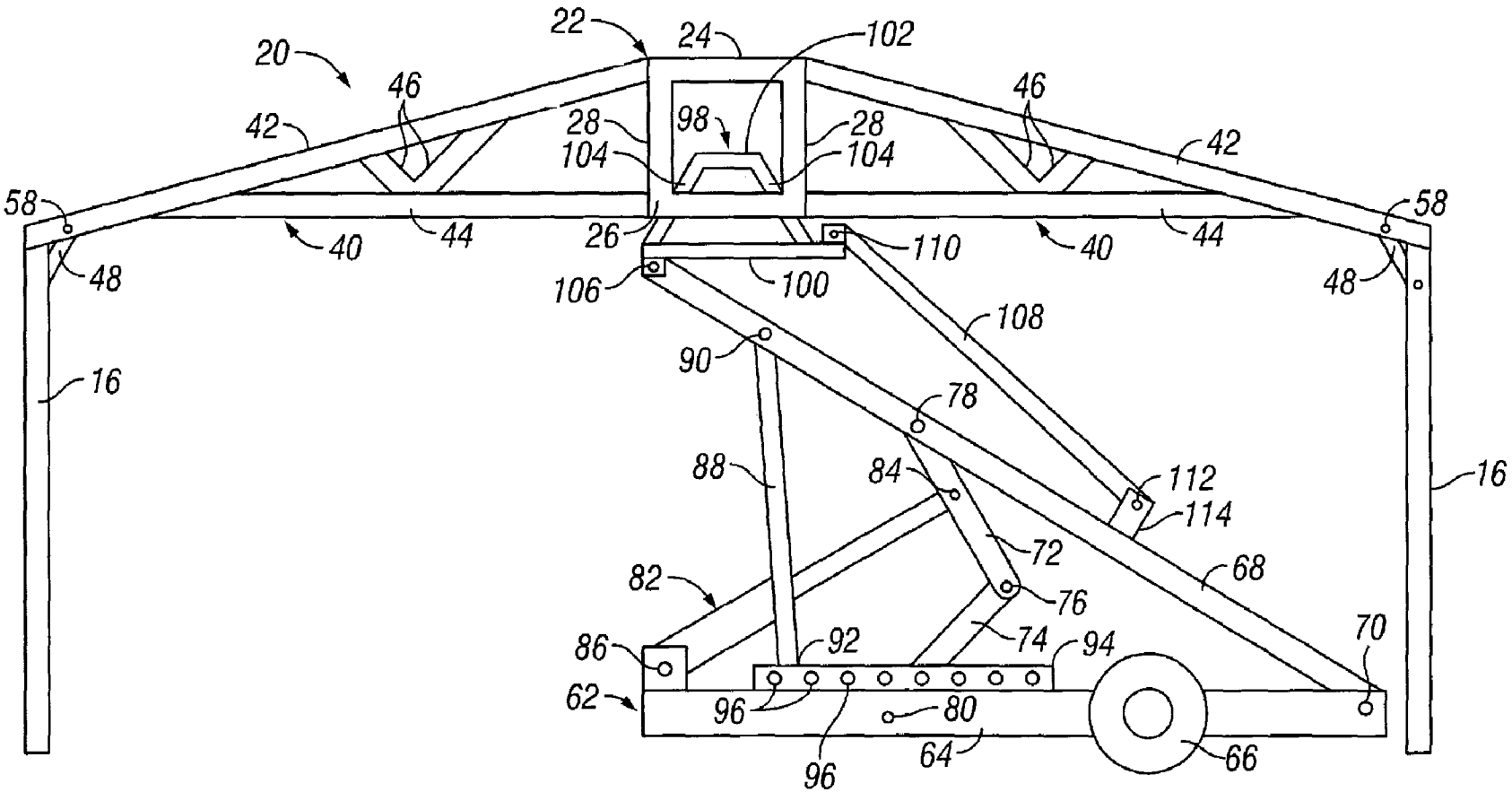
FIG. 3 is a sectional view taken along line 3—3 of FIG. 2, and also showing the trailer used for helping to erect the tent.
Figure 7:
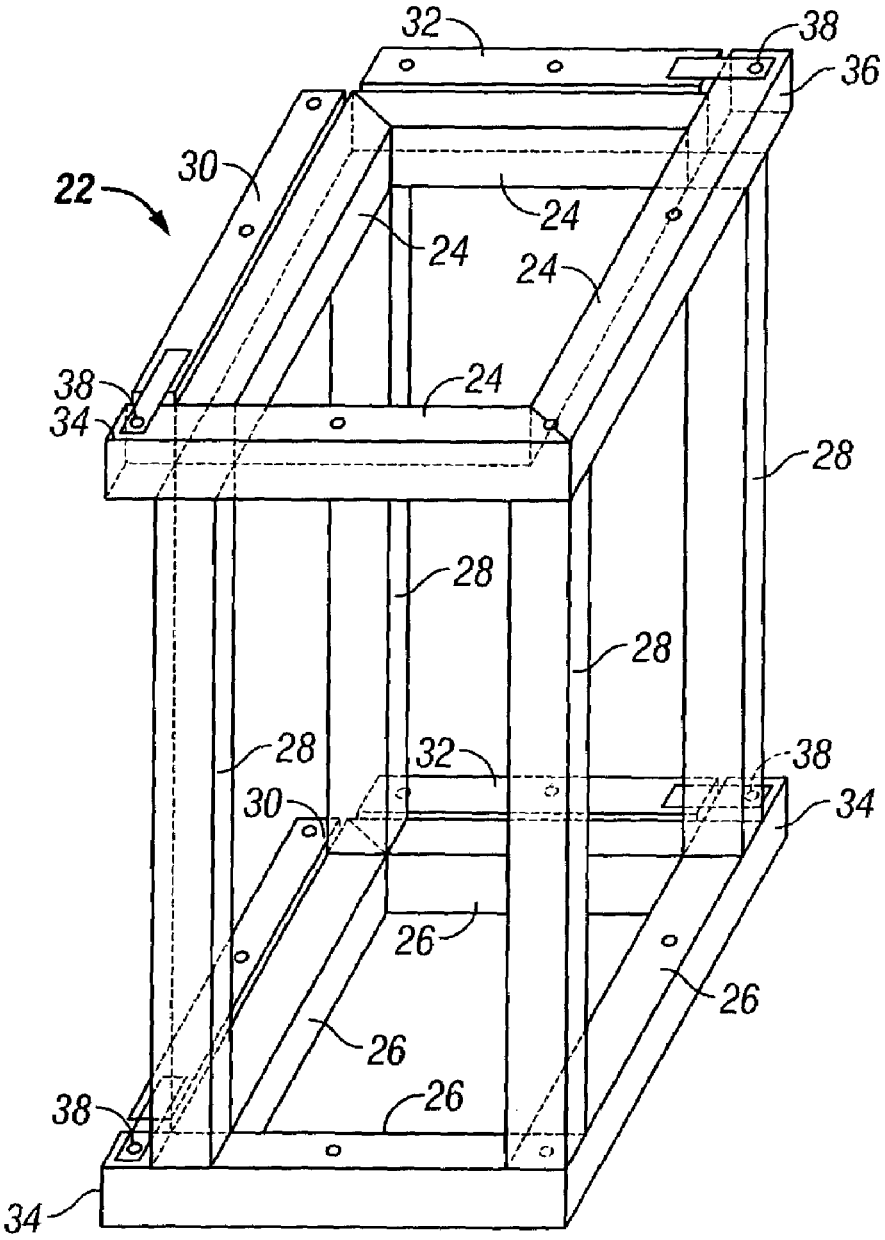
FIG. 7 is a perspective view of the central frame of the present invention.

Referring to FIGS. 2 and 3 a roof frame 20 comprises a central rectangular frame 22 which has four top frame members 24 (FIG. 7), four bottom frame members 26, and four vertical frame members 28. At both the top frame members 24 and the lower frame members 26, are two swing frame members 30, 32, each pivoted to a pivot ear 34, 36 respectively for pivoting movement about axis 38.

A plurality of roof support members or trusses 40 are pivotally mounted to the central rectangular frame for pivotal movement about either a roof support axis 41 or the axis 38 on pivot ears 34, 36. Each roof support member or truss 40 is comprised of an upper member 42 (FIG. 3), a lower member 44, and a pair of V-shaped truss members 46 therebetween.

Figure 6:
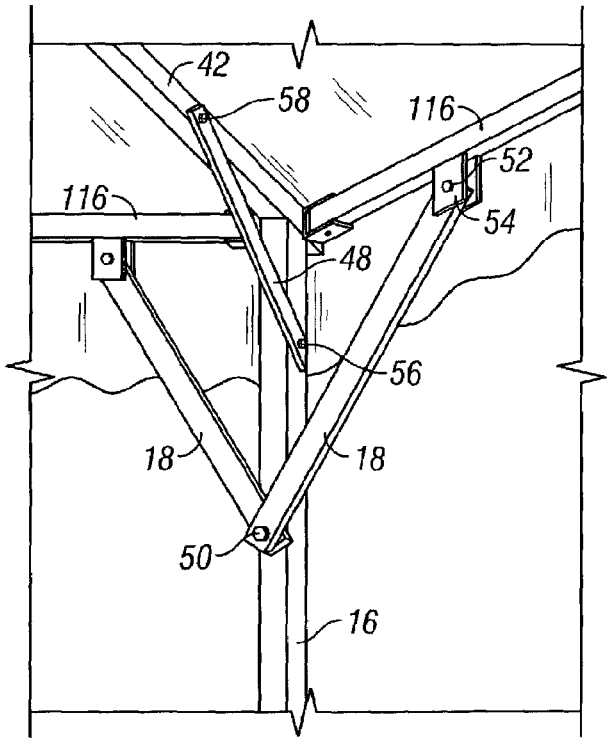
FIG. 6 is a perspective view of the juncture between the support legs and the roof support frames of the present invention.

At the outer end of each upper frame member 42 is a leg strap 48 which is pivotally mounted about strap pivot axis 58 to the upper frame member 42 (FIG. 6) and which is pivotally mounted at its lower end about a strap pivot axis 56 to the upper end of leg 16. FIG. 6 shows the manner in which the struts 18 are attached to the upper perimeter members 116 and to the legs 16 for providing support thereto. Each strut 18 is connected at its upper end by means of an upper strut bolt 52 to a pair of strut ears 54 and is connected at its lower end by a lower strut bolt 50 to the upstanding legs 16.

Figure 5:
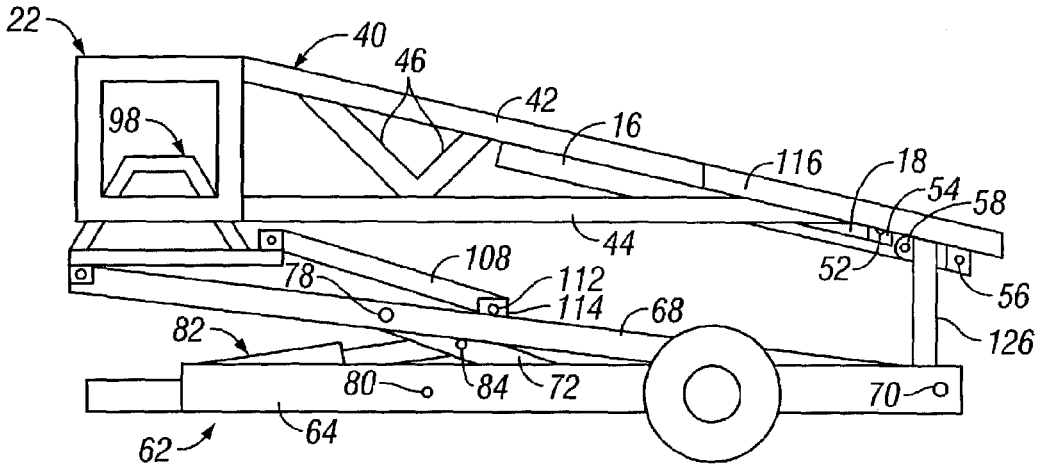
FIG. 5 is a side elevational view of the folded tent on the trailer.

The lower bolts 50 may be removed from the struts 18 so that they can fold against perimeter members 116 as shown in FIG. 5. Also, the leg 16 can be pivoted about its pivotal connection 56, 58 to the strap 48. It ultimately can be pivoted into juxtaposition underneath the upper frame member 42 as also shown in FIG. 5.

Figure 4:
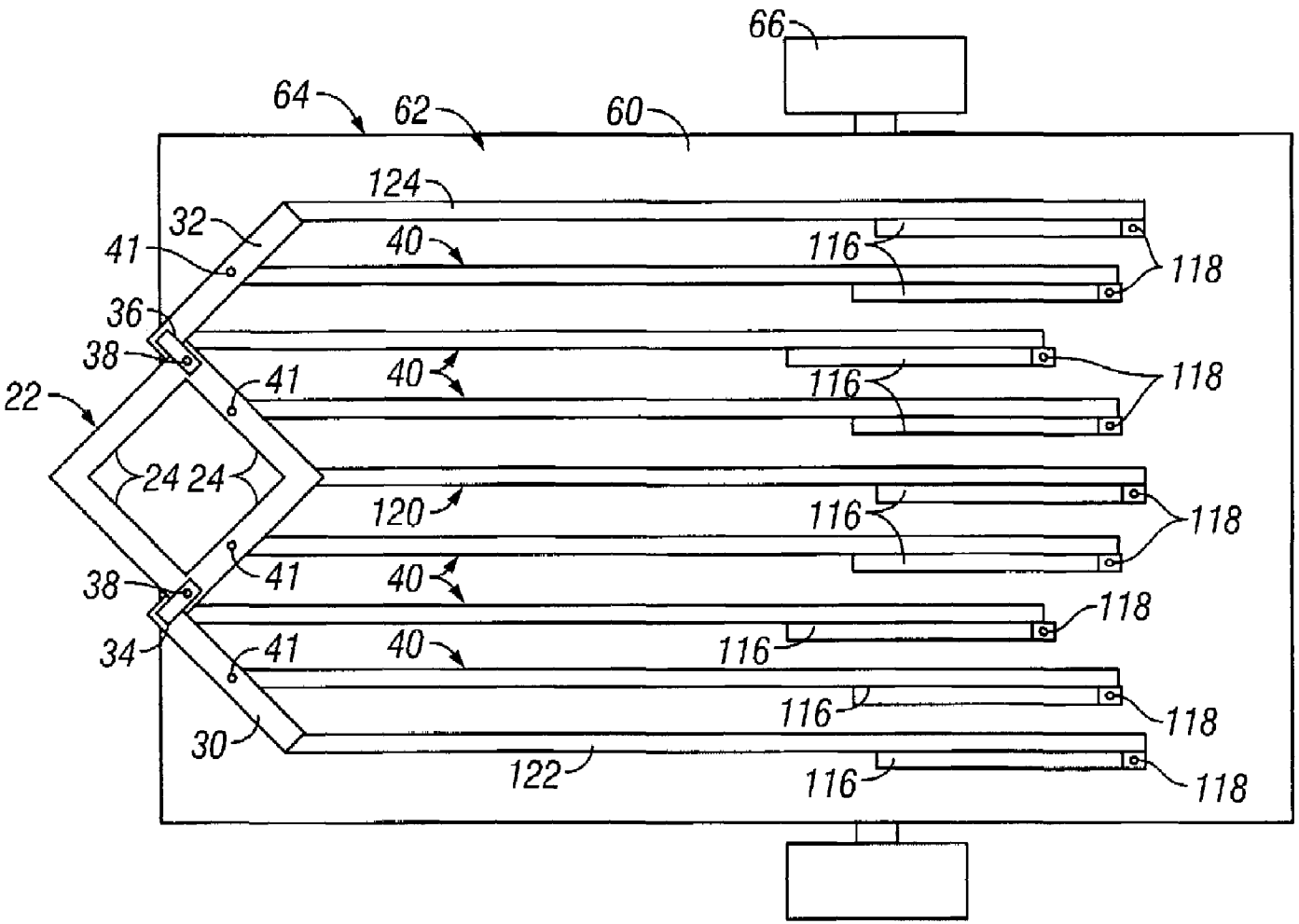
FIG. 4 is a top plan view of the trailer with the tent frame in its folded position on the trailer.

Referring to FIGS. 3, 4 and 5, a trailer 62 includes a trailer frame 64 supported by a pair of wheels 66. The trailer frame 62 includes a trailer bed 60 supported thereon. A lift boom 68 is pivoted at one to the trailer frame 64 for pivotal movement about a boom axis 70. A pair of scissors links 72, 74 are pivotally connected to one another about a common scissors axis 76. The upper end of scissors link 72 is pivotally connected to the boom 68 for pivotal movement about an upper scissors axis 78. The scissors link 74 is pivotally connected at its lower end to the trailer frame 64 for pivotal movement about a lower scissors axis 80. A hydraulic cylinder 82 is pivotally connected to the upper scissors link 72 for pivotal movement about an upper cylinder axis 84. The lower end of the hydraulic cylinder 82 is pivotally mounted to the trailer frame 64 for pivotal movement about a lower cylinder axis 80. The extension of the hydraulic cylinder 82 causes the linkage 72, 74 to spread and by so doing raises the lift boom 68 to its elevated position shown in FIG. 3. Retraction of the hydraulic cylinder 82 causes the lowering of the lift boom 68.

A lock arm 88 is pivotally connected at its upper end to lift boom 68 for pivotal movement about axis 90. The lower end 92 of lock arm 88 drags across a stop track 94 having a plurality of bolts 96 therein during the raising of the lift boom 68. As the lower end of the lock arm 88 drags over these plurality of bolts 92 it provides a stop which supports the lift boom in the event that the cylinder 82 fails for some reason.

At the upper end of lift boom 68 is a lift head frame 98 which is comprised of four bottom frame members 100 arranged in a square and four upper frame members 102 arranged in a square. The lower and upper frame members 100 and 102 are connected by four trapezoidal frame members 104 so as to create a trapezoidal shape to the lift head frame 98 with the upper end of the lift head frame 98 being smaller than the lower end of the lift head frame 98. Another way of describing the shape of lift head frame 98 is as a pyramid with the pointed top cut off. The lift head is pivotally connected to the upper end of the lift frame 68 for pivotal movement about a lift head axis 106.

A leveling arm 108 is connected at its upper end to the lift head frame 98 for pivotal movement about an upper leveling arm axis 110. The leveling arm 108 is a connected to a stub frame 114 for pivotal movement about a lower arm axis 112. As the lift arm 68 raises a lowers, the leveling arm 108 maintains the lift head frame 98 in a horizontal disposition.

Referring to FIG. 2, the plurality of perimeter members 116 are connected at their opposite ends to the roof support frame members 40 for pivotal movement about bolt connections 118. In addition to the roof support members 40, there is a large welded truss member 120 which is welded to the central frame 22 and which does not pivot with respect thereto. Similarly there is a small welded truss 122 and another small welded truss 124 which are also welded and rigidly connected to the swing frame members 30, 32.

The folding of the tent 10 is best shown in FIGS. 4 and 5 and also with reference with to FIG. 2. The two swing frame members 30, 32 are pivoted about their axes 38 from the position shown in FIG. 2 to the position shown in FIG. 4. In this position the small welded trusses 122, 124 extend rearwardly with respect to the trailer frame 64. The perimeter members 116 are folded by removing one of the bolts 118 and pivoting the members 116 from the position shown in FIG. 2 to their folded position shown in FIG. 4. As can be seen in FIG. 5, the legs 16 are folded from their upstanding position shown in FIG. 3 to a position shown in FIG. 5 wherein the legs 16 are substantially parallel to the upper frame member 42 of the roof support frame 40. Similarly the struts 18 are pivoted about strut bolts 52 from the position shown in FIG. 6 to the position shown in FIG. 5. The rectangular lift head frame 98 remains inserted within the rectangular central frame 22 so as to permit the folded support structure to be lowered to the position shown in FIG. 5 for transporting. It should be noted that FIGS. 2, 3, 4, and 5 show the support frame for the tent without the tarpaulin 12 attached. However, the tarpaulin 12 is attached at all times, and folds with the frame from the position in FIGS. 1 and 2 to the folded position mounted on the trailer in FIG. 5.

FIG. 5 shows the manner in which the tent is transported. Once the tent is transported to the site for erection, the roof support members 40 are pivoted from their folded position shown in FIGS. 4 and 5 to their fanned position shown in FIG. 2. Then the perimeter members 116 are moved from their folded position shown in FIG. 5 to their unfolded position shown in FIG. 2 and the bolts 118 are used to attach the perimeter members 116 in the configuration shown in FIG. 2. Then the hydraulic cylinder is actuated to lift the lift head frame 98 upwardly so as to cause the roof support frame to be lifted to the position shown in FIG. 3. The legs 16 are then pivoted downwardly to their upstanding position shown in FIG. 3 and the struts 18 are unfolded and moved to the position shown in FIG. 6 where they are held in place by bolt 50. At this point the roof structure is supported by legs 16 and the lift head frame 98 may be lowered and the trailer removed, thereby leaving the tent in the position shown in FIG. 1.

The tent can be erected in this manner by one person, and the time needed to erect the tent is usually less than one-half hour.

While the tent shown in the present invention utilizes eight sides, a similar structure can be provided with four sides, six sides, or in a square or rectangular configuration. All that is necessary in order to do so is to change the number of roof support members 40 pivotally mounted to the central frame 22.

In the drawings and specification there has been set forth a preferred embodiment of the invention, and although specific terms are employed, there are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A portable folding tent comprising:

a trailer having wheels for engaging a supporting surface;

a lift mechanism comprising a lift head, the lift mechanism being connected to the trailer for movement from a lowered position wherein the lift head is adjacent the trailer to an elevated position wherein the lift head is above the trailer;

an extensible power member having a first end connected to the trailer and a second end connected to the lift mechanism for raising and lowering the lift mechanism between the elevated and lowered positions respectively;

a roof frame comprising a central frame and a plurality of roof support members, each having a first end connected to the central frame and a second end extending away from the central frame;

a plurality of legs, each of which has an upper leg end connected to one of the second ends of one of the roof support members, and a lower leg end;

a flexible sheet member attached in covering relation over the roof support members;

the lift head of the lift mechanism engaging and supporting the central frame of the roof frame whereby the lift mechanism will raise the central frame as the lift mechanism moves from the lowered position to the elevated position.

2. A portable folding tent according to claim 1 wherein the plurality of roof support members are pivotally mounted to the central frame for movement from a folded position to a fanned position wherein the plurality of roof support members are arranged in a circular array with the central frame at the center and with the roof support members extending in a radial direction away from the central frame.

3. A portable folding tent according to claim 2 wherein each of the plurality of legs is pivotally connected to the one of the second ends of one of the roof support members for folding movement from a folded position to an upstanding position wherein the lower leg end engages the supporting surface and the leg extends upwardly therefrom.

4. A portable folding tent according to claim 3 wherein when the plurality of legs and the plurality of roof support members are moved to their respective folded positions the roof frame and the legs are more compact and occupy less space than when the plurality of legs are in their respective upstanding positions and the plurality of roof members are in their respective fanned positions.

5. A portable folding tent comprising:

a roof frame comprising a central frame and a plurality of roof support members, each having a first end connected to the central frame and a second end extending away from the central frame;

a plurality of legs, each of which has an upper leg end connected to one of the second ends of one of the roof support members, and a lower leg end;

the plurality of roof support members being pivotally mounted to the central frame for movement from a folded position to a fanned position wherein the plurality of roof support members are arranged in a circular array with the central frame at the center and with the roof support members extending in a radial direction away from the central frame;

each of the plurality of legs being pivotally connected to the one of the second ends of one of the roof support members for folding movement from a folded position to an upstanding position wherein the lower leg end engages the supporting surface and the leg extends upwardly to the upper leg end connected to the one second end of the one roof member;

the plurality of roof support members and legs when in their respective folded positions being more compact and occupying less space than when the roof support members are in their respective fanned positions and the legs are in their respective upstanding positions;

a lift mechanism engaging the central frame of the roof frame and being moveable from a lowered position supporting the roof frame in the folded position to an elevated position supporting the roof frame in the upstanding position higher than the first position;

the lift mechanism being mounted on a trailer having ground engaging wheels.

6. A portable folding tent according to claim 5 wherein the plurality of roof support members and the plurality of legs when in their respective folded positions fit upon and are supported upon the trailer for transporting with the lift mechanism including a lift head retentively engaging the central frame.

7. A method for erecting a tent on a supporting surface comprising:

transporting a tent frame in a folded state on a trailer to the site for erecting the tent;

pivoting a plurality of roof support members pivotally connected to a central frame from a folded position to a fanned position extending in an outward radial direction from the central frame;

lifting the central frame and the roof support members from a lowered position adjacent the supporting surface to an elevated position spaced a predetermined distance above the supporting surface, wherein the lifting step comprises engaging the central frame with a lift mechanism mounted on the trailer and moving the lift mechanism from a lowered position adjacent the supporting surface to an elevated position said lifting step further comprises actuating a power member engaging the trailer and the lift mechanism for moving the lift mechanism from the lowered to the elevated positions;

pivoting a plurality of legs, each having an upper end pivotally connected to one of the roof support members and a lower end, from a folded position to an upstanding position wherein the lower end engages the supporting surface and the upper end supports the central frame and roof support members in the elevated position.

8. A method according to claim 7 wherein the lifting mechanism includes a lifting head thereon, and the lifting step comprises retentively engaging the central frame with the lifting head of the lifting mechanism.

9. A method according to claim 8 and further comprising pivoting the plurality of roof support members and the plurality of legs to their respective folded positions.

10. A method according to claim 9 and further comprising lowering the lifting mechanism to the lowered position whereby the plurality of roof support members and the plurality of legs will be lowered and will be supported upon the trailer.

* * * * *